US007021896B2

(12) United States Patent
Dodd

(10) Patent No.: US 7,021,896 B2
(45) Date of Patent: Apr. 4, 2006

(54) TURBINE BLADE

(75) Inventor: Alec G Dodd, Derby (GB)

(73) Assignee: Rolls-Royce plc, London (GB)

( * ) Notice: Subject to any disclaimer, the term of this patent is extended or adjusted under 35 U.S.C. 154(b) by 27 days.

(21) Appl. No.: 10/843,381

(22) Filed: May 12, 2004

(65) Prior Publication Data

US 2005/0135932 A1 Jun. 23, 2005

(30) Foreign Application Priority Data

May 23, 2003 (GB) ..... 0311877

(51) Int. Cl.
*F01D 5/18* (2006.01)

(52) U.S. Cl. ..... 416/97 R

(58) Field of Classification Search ..... 416/96 R, 416/96 A, 97 R; 415/115–116
See application file for complete search history.

(56) References Cited

U.S. PATENT DOCUMENTS 3,527,543 A * 9/1970 Howald ..... 416/90 R
3,628,885 A * 12/1971 Sidenstick et al. ..... 416/97 R
3,819,295 A 6/1974 Hauser
5,374,162 A * 12/1994 Green ..... 416/97 R
5,496,151 A * 3/1996 Coudray et al. ..... 416/97 R
5,700,131 A * 12/1997 Hall et al. ..... 416/97 R
6,164,912 A * 12/2000 Tabbita et al. ..... 416/97 R
6,869,268 B1 * 3/2005 Liang ..... 415/115
6,884,029 B1 * 4/2005 Beeck ..... 416/97 R

FOREIGN PATENT DOCUMENTS

EP 0641917 A 3/1995
GB 1188401 P 4/1970
GB 2310896 A 9/1997
JP 58-51202 * 3/1983 ..... 416/97 R
JP 1162504 A 8/1997

* cited by examiner

*Primary Examiner*—Christopher Verdier
(74) *Attorney, Agent, or Firm*—W. Warren Taltavull; Manelli Denison & Selter PLLC

(57) ABSTRACT

A turbine blade (20) has cooling air passageways (30) and (30*a*, 30*b*, 30*c*.) through the leading edge wall portion (24) which are positionally arranged so as to intersect each other within the wall thickness so as to transmit mechanical stresses into the thicker, non-perforated material of the blade aerofoil (22). Further passageways near the blade root portion (42) do not intersect, the reduced cooling in that area causes expansion and stress absorption.

3 Claims, 2 Drawing Sheets

TURBINE BLADE

FIELD OF THE INVENTION

The present invention relates to turbine blades of the kind used in a high temperature environment as is experienced in an operating gas turbine engine that incorporates those blades.

BACKGROUND OF THE INVENTION

It is the common practice to make the aerofoil portion of such blades hollow, and to provide a multiplicity of passageways through the leading edge portion of the aerofoil, so as to connect the blade interior with the gas stream flowing over the aerofoil outer surface. Relatively cool compressor air is then pumped into the blade interior from where it flows via the passageways, into the gas stream.

It is also common practice to cool the trailing edge region of the aerofoil, by providing further passageways to connect the blade interior to that region, which may be immediately upstream of the trailing edge extremity, or the trailing edge extremity itself.

The above mentioned practices include the radial spacing of the passageways from and in parallel with each other in a direction from root to tip of the aerofoil, so as to achieve the maximum possible cooling effect. However, in so doing, the positioning of the passageways takes no account of mechanical stresses that the turbine blades experience during rotation in an operating gas turbine engine. The stresses result from forces generated by the aforementioned rotation and acting in a direction substantially radially of the axis of rotation, and forces generated by vibration, which forces act in the manner of a cantilever on the blade aerofoils. Both kinds of force generate the highest loads on the root portion of the aerofoil.

SUMMARY OF THE INVENTION

The present invention seeks to provide an improved air cooled turbine blade.

According to the present invention a turbine blade has a hollow aerofoil portion provided with a multiplicity of cooling air passageways through at least its leading edge wall portion, which said passageways connect the interior of said hollow aerofoil portion with the aerofoil portion exterior, and are angularly arranged with respect to each other and said aerofoil such that their axes intersect within the thickness of said wall portion and their respective rim profiles at the aerofoil exterior define or approximate ellipses.

BRIEF DESCRIPTION OF THE DRAWING

The invention will now be described, by way of example and with reference to the accompanying drawings in which.

DETAILED DESCRIPTION OF THE INVENTION

Figure 1:
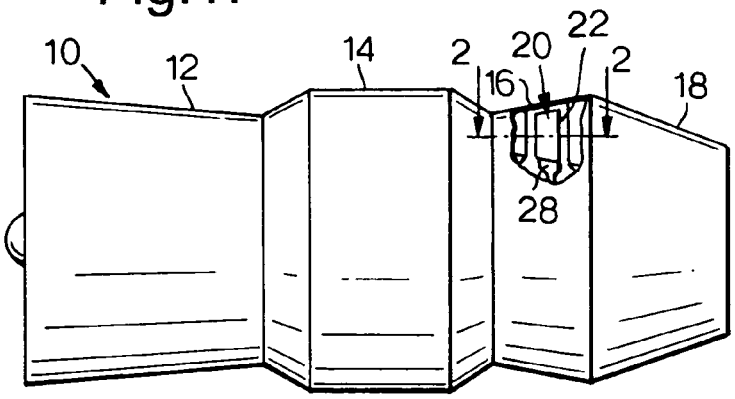
FIG. 1 is a diagrammatic sketch of a gas turbine engine including a stage of hollow turbine blades the interiors of each of which are being connected to its respective blade exterior via angled passageways in accordance with the present invention.

Referring to FIG. 1. A gas turbine engine indicated generally by the numeral 10 has a compressor 12, combustion equipment 14, a turbine section 16 and an exhaust duct 18. The turbine section 16 is a stage of disk mounted turbine blades 20, only one of which is shown, each of which blades 20 has a hollow aerofoil 22.

Figure 2:
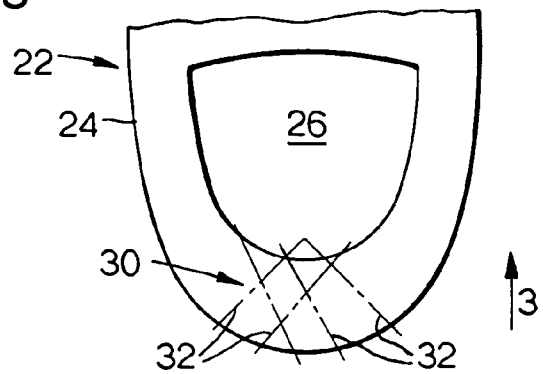
FIG. 2 is a cross sectional part view on line 2—2 of FIG. 1.

Referring now to FIG. 2. The aerofoil wall 22 of each blade 20 (only the leading edge portion 24 of one blade being shown) bounds a blade interior 26. During operation of gas turbine engine 10, blade interior 26 receives cool air from compressor 12 via central ducting (not shown), the face of disk 28 (FIG. 1) and passageways in the root of blade 20, in known manner and consequently not shown in the drawings. Thereafter, the air exits the blade interior 26 via passageways 30 through wall portion 24. The axes 32 of only a few of passageways 30 are shown in FIG. 2. Other passageways are described later in this specification. In the present example, the axes 32 of passageways 30 intersect in one or more places along their lengths, the number of intersections being dependant on their respective orientations. Intersecting passageways 30 are provided over a major portion of the length of the leading edge portion of aerofoil wall 22, starting near the radially outer end thereof and ending short of the aerofoil juncture with the blade root so as to avoid weakening the structure in that area.

Figure 3:
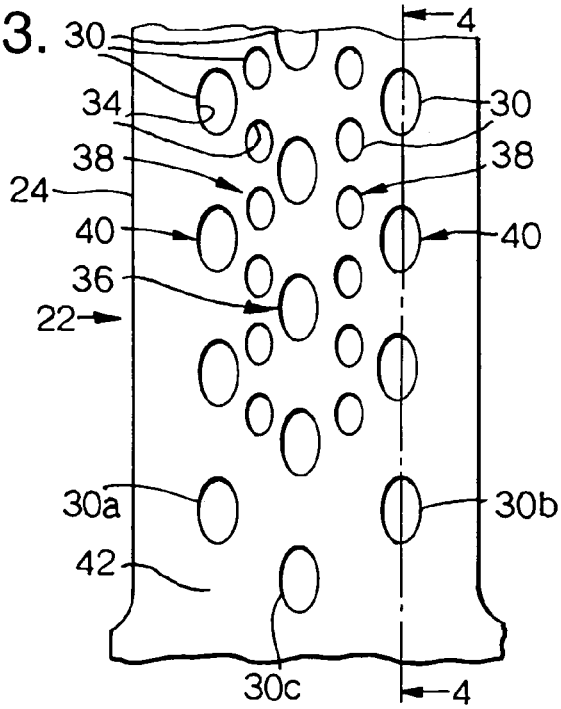
FIG. 3 is a view in the direction of arrow 3 in FIG. 2.
Figure 4:
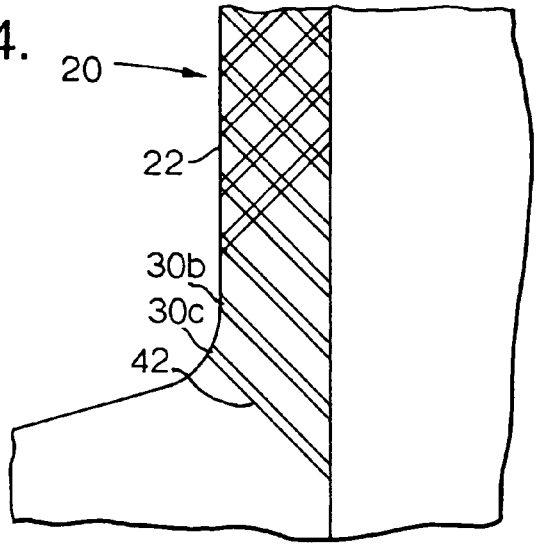
FIG. 4 is a cross sectional view on line 4—4 of FIG. 3.

It is further seen from FIG. 2 that passageways 30 diverge from each other, and from FIG. 4 that they cross at angles towards and away from the axis of rotation of the engine 10 (FIG. 1). The arrangement ensures that the rims 34 of the passageways 30 at the exterior surface of wall 24 define shapes that at least approximate ellipses. This latter feature is illustrated in FIG. 3.

Referring now to FIG. 3, which is a developed part view of the leading edge portion 24 of aerofoil 22, and shows the positional relationship of the rims 34 of passageways 30 at the exterior surface of wall 24. In the present example, five rows of passageways 30 exit wall 24, the rows being lengthwise of aerofoil 22. A central row 36 of given size is bracketed, firstly by rows 38 of smaller size and then by rows 40 of similar size. However, in the area adjacent the root portion 42 of aerofoil 22, those passageways 30*a*, 30*b*, and 30*c* that terminate the respective rows are more widely spaced from the remainder thereof, and moreover, do not intersect any other passageway 30. The non-intersecting arrangement is clearly seen in FIG. 4. There results a greater bulk of solid material in the root area of aerofoil 22, than in its length extending therefrom to the tip of aerofoil 22.

Figure 5:
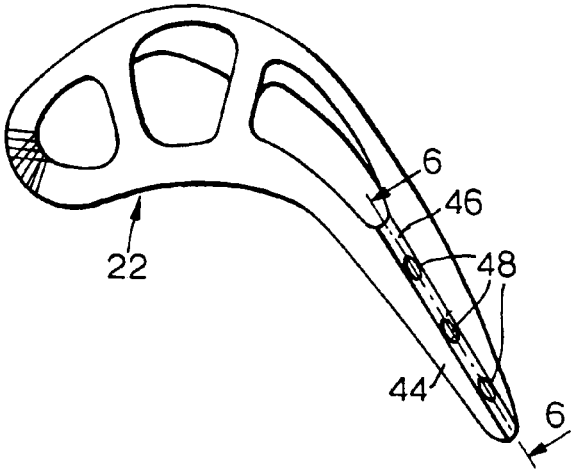
FIG. 5 is a full chord cross section through the turbine blade.

Referring to FIG. 5. The trailing edge portion 44 of aerofoil 22 is also provided with numerous intersecting passageways, numbered 46 and 48, depending on their orientation, and which connect the blade interior and engine gas passage in the same manner as in the examples of FIGS. 2, 3 and 4. However the relatively narrow chordal width of trailing edge portion 44 dictates that the passageways 46 and 48 must be contained in a single common plane lengthwise of aerofoil 22.

Figure 6:
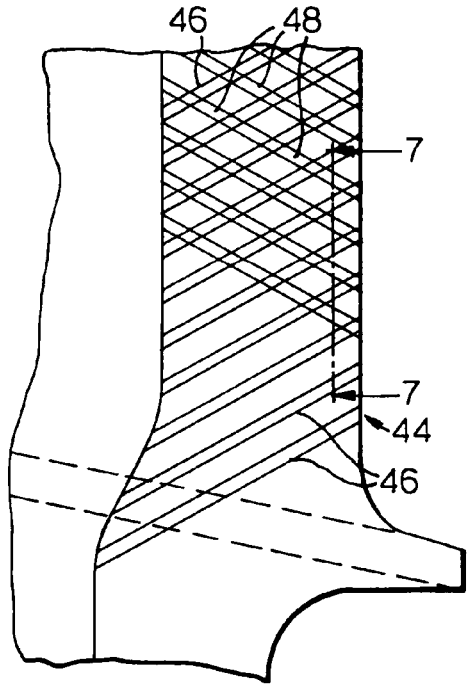
FIG. 6 is a cross sectional view on line 6—6 of FIG. 5.

Referring to FIG. 6. The multiple intersections of passageways 46 with passageways 48 in trailing edge portion 44 are clearly shown. Also, as in the arrangement of the passageways in the aerofoil leading edge portion 24, passageways 46 near the root portion of blade do not intersect passageways 48, so as to ensure a greater bulk of solid material in that region.

Figure 7:
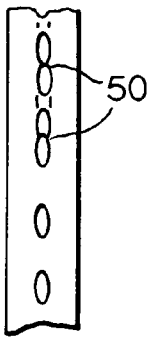
FIG. 7 is a cross sectional part view on line 7—7 of FIG. 6.

Referring to FIG. 7. In the region where passageways 46 and 48 intersect, cusps 50 are formed. During operation of engine 10, load stresses concentrate in the cusps and of course throughout aerofoil 22. However, those stresses are effectively manipulated by the intersecting and non-intersecting passageways in the following manner. The intersecting passageways 30 and passageways 46 and 48 locally considerably reduces the material bulk in aerofoil 22. There results at least a part migration of the radial mechanical loads that are applied during operational rotation away from the passageways into the non perforated and therefor relatively bulky flanks of aerofoil 22. The non-intersecting passageways provide relatively greater material bulk at the root portion 42 of aerofoil 22, which results in reduced cooling of the root portion 42 and causes it to expand. This effects offloading of the stresses in the area of the non-intersecting passageways. Finally, the substantially elliptical outlet rims 34, the major axes of which are parallel or near parallel with the length of aerofoil 22, provide a reduced rate of change of material thickness between adjacent passageway rims. This also reduced the affect of stresses at the plane containing the nearest points between adjacent rims. Overall, therefor, turbine blade 20 of the present invention experiences lower operating stresses than is achieved by prior art arrangements.

The man skilled in the art, having read this specification accompanied by the drawings, will appreciate that the precise size, disposition and shape of the passageways 30 and 46 and 48 will depend on the material of aerofoil 22, the maximum temperature aerofoil 22 will experience during operation in a gas turbine engine, and the mechanical stresses it will be subjected to during that operation. The only limiting factor is the need to ensure that a sufficient bulk of material is provided at the root area of aerofoil 22 to absorb the mechanical stresses at the maximum operating temperature. Further cooling air passageways arranged generally as described herein may be utilised to achieve cooling of any region of aerofoil 22, and to reap the associated stress distribution benefits.

I claim:

1. A turbine blade having a hollow aerofoil portion provided with a multiplicity of cooling air passageways through at least its leading edge wall portion, which said passageways connect the interior of said hollow aerofoil portion with the aerofoil portion exterior, and are angularly arranged with respect to each other and said aerofoil such that their axes intersect within the thickness of said wall portion and their respective rim profiles at the aerofoil exterior at least approximate ellipses wherein said intersecting passageways extend from a position near the tip of said aerofoil portion along a major portion of the length of said aerofoil portion; said turbine blade includes further passageways connecting the interior of said hollow aerofoil portion with the exterior of said aerofoil portion, which said further passageways are angularly arranged with respect to said aerofoil portion without intersecting each other, and are positioned in at least said aerofoil leading edge wall portion in the vicinity of its juncture with the root of said turbine blade.

2. A turbine blade as claimed in claim 1 wherein the rims of the passageways at the exterior surface of the wall define ellipses.

3. A turbine blade as claimed in claim 1 including further passageways connecting the turbine blade interior with the exterior of said turbine blade, which are angularly arranged with respect to said aerofoil portion but do not intersect each other, and are positioned in a trailing edge portion in the vicinity of its juncture with the root of the turbine blade.

* * * * *